United States Patent [19]

Ichida et al.

[11] 4,238,534

[45] Dec. 9, 1980

[54] METHOD FOR FORMING A HEAT-RESISTANT COATING ON AN ORIENTED SILICON STEEL SHEET

[75] Inventors: Toshio Ichida; Toshihiko Funahashi, both of Chiba, Japan

[73] Assignee: Kawasaki Steel Corporation, Kobe City, Japan

[21] Appl. No.: 963,987

[22] Filed: Nov. 27, 1978

Related U.S. Application Data

[63] Continuation-in-part of Ser. No. 714,312, Aug. 16, 1976, abandoned.

[30] Foreign Application Priority Data

Aug. 22, 1975 [JP] Japan ..... 50/101130

[51] Int. Cl.[2] ..... B05D 3/02

[52] U.S. Cl. ..... 427/376.5; 148/6.15 R; 148/6.16; 427/380; 427/419.1

[58] Field of Search ..... 427/376 D, 380, 372 R, 427/419 R, 419 E; 428/450, 539; 148/6.15 R, 6.16, 113, 12 A

[56] References Cited

U.S. PATENT DOCUMENTS

| | | | |
|---|---|---|---|
| 3,150,015 | 9/1964 | Boyer et al. | 427/376 |
| 3,151,000 | 9/1964 | Schmidt et al. | 148/6.15 |
| 3,248,249 | 4/1966 | Collins | 148/6.16 |
| 3,562,011 | 2/1971 | Hirst et al. | 148/6.16 |
| 3,627,594 | 12/1971 | Yamamoto | 148/113 |
| 3,700,506 | 10/1972 | Tanaka et al. | 148/6.24 |
| 3,705,826 | 12/1972 | Hirst et al. | 148/6.16 |
| 3,856,568 | 12/1974 | Tanaka et al. | 148/6.16 |
| 3,948,786 | 4/1976 | Evans | 148/6.16 |
| 3,985,583 | 10/1976 | Shimanaka et al. | 148/6.16 |

*Primary Examiner*—Ronald H. Smith
*Assistant Examiner*—S. L. Childs
*Attorney, Agent, or Firm*—Balogh, Osann, Kramer, Dvorak, Genova & Traub

[57] ABSTRACT

A heat-resistant insulating coating having a high adhesion can be formed on an oriented silicon steel sheet by the use of an aqueous coating dispersion containing colloidal silica dispersed therein, at least one of monobasic phosphates of Mg, Al, Sr, Ba and Fe, at least one compound selected from chromic acid anhydride, chromate and dichromate, and at least one fine particle oxide selected from $SiO_2$, $Al_2O_3$ and $TiO_2$ having a primary particle size of 70–500Å and an apparent density of not higher than 100 g/l. The steel sheet having the coating is low in the iron loss and magnetostriction and shows good heat-resistant property.

8 Claims, 5 Drawing Figures

(x 3000)

(x 3000)

(x1000)

METHOD FOR FORMING A HEAT-RESISTANT COATING ON AN ORIENTED SILICON STEEL SHEET

Figure 1:
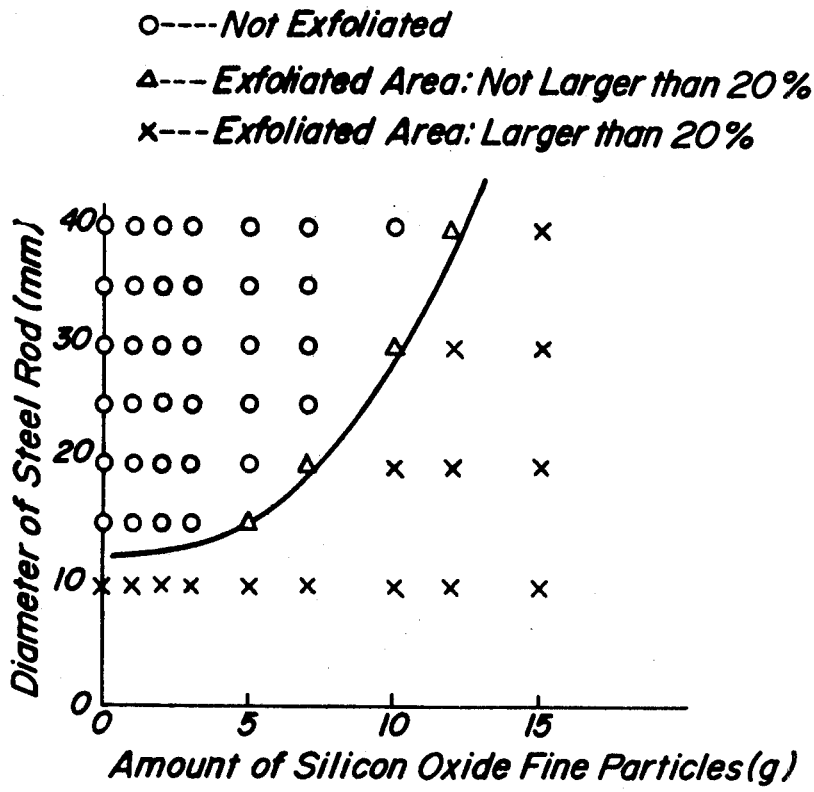

This application is a continuation-in-part of Ser. No. 714,312, filed Aug. 16, 1976 and now abandoned.

The present invention relates to a method for forming an insulating coating on a crystalline forsterite-ceramic film formed on an oriented silicon steel sheet. More particularly, the present invention relates to a method for forming a heat-resistant insulating coating on an oriented silicon steel sheet, said coating being able to decrease the iron loss and suppress the magnetostriction of the steel sheet.

The magnetostriction of oriented silicon steel sheet is caused by the stretching vibration of the steel sheet at the magnetization, and the transformer noise is mainly due to the magnetostriction. The magnetostriction of a steel sheet is influenced by the magnetic domain structure of the steel sheet, and if a tensile stress is given to an oriented silicon steel sheet by a coating formed on the steel sheet, the steel can be magnetized by the 180° magnetic domain wall movement without causing magnetostriction, and therefore the magnetostriction decreases considerably. Moreover, it is known that a tensile stress given to an oriented silicon steel sheet is not only effective for suppressing the magnetostriction, but also effective for decreasing the iron loss of the steel sheet. Particularly, when a coating is formed on a recently progressed oriented silicon steel sheet having a high magnetic induction to give a tensile stress to the steel sheet, the iron loss of the steel sheet is remarkably decreased, and at the same time the magnetostriction of the sheet is suppressed, and a small size transformer having a low noise and a low core loss can be produced.

There have been proposed various methods for forming a coating capable of giving a tensile stress to the steel sheet, and these methods are classified into two methods, The one is a method, wherein an aqueous suspension of pulverized glass frit is applied to a steel sheet and the coated steel sheet is baked; and the other is a method, wherein a mixture of a solution of a phosphate and colloidal silica is applied to a steel sheet and the coated steel sheet is baked. The former method is disclosed, for example, in U.S. Pat. No. 2,920,296. The latter method is disclosed, for example, in U.S. Pat. No. 3,856,568 and Japanese Laid Open Specification No. 79,442/75.

These methods are effective for suppressing the magnetostriction of oriented silicon steel sheet and decreasing the iron loss thereof. Particularly, according to the latter method, an aqueous coating dispersion containing (a) colloidal silica, (b) at least one of monobasic phosphates of Mg, Al and other metals, and (c) at least one compound selected from chromic acid anhydride, chromates and dichromates is applied to an oriented silicon steel sheet by means of a commonly used apparatus and the coated steel sheet is baked, whereby an adhesive coating can be formed on the steel sheet to give a tension to the steel sheet and to suppress the magnetostriction thereof. Therefore, this method is widely used in industry.

However, according to this method, although a coating having a high adhesion can be obtained, the coating is poor in the heat resistance. When a silicon steel sheet having this coating is wound into a wound-core type transformer, and the transformer is subjected to a stress relief annealing at about 800° C., adjacent coating layers are often stuck to each other, resulting in the decrease of the insulation resistance of the iron core of the transformer and in the deterioration of the magnetic properties thereof. Therefore, the sticking of adjacent coating layers must be prevented. Further, in the case of a wound core called as a lap core, if sticking of coating occurs at the stress relief annealing, the lap core type transformer can not be built-up.

It is an object of the present invention to provide a method for forming a heat resistant and adhesive insulating coating on an oriented silicon steel sheet, said coating being free from sticking at the annealing and being able to decrease the iron loss and suppress the magnetrostriction of the steel sheet.

The inventors have newly found out that a heat-resistant and adhesive insulating coating can be formed on an oriented silicon steel sheet without deteriorating the space factor of the coated steel sheet and sticking of the coated layers by a method, wherein an aqueous coating dispersion having a specific gravity of 1.05–1.30, which is obtained by mixing (a) 22.4 g, calculated as $SiO_2$, of colloidal silica dispersed in water with (b) at least one of monobasic phosphates of Mg, Al, Sr, Ba and Fe in a molar ration of $SiO_2$ in the colloidal silica/monobasic phosphate of 0.8/1–15/1, (c) 0.1–20 g of the total amount of at least one compound selected from chromic acid anhydride, chromate and dichromate, (d) 0.1–10 g of the total amount of at least one fine particle oxide selected from $SiO_2$, $Al_2O_3$ and $TiO_2$ having a primary particle size of 70–500 Å and an apparent density of not higher than 100 g/l, and (e) water so as to adjust the specific gravity of the aqueous coating dispersion to the above described range is applied to an oriented silicon steel sheet, and the coated steel sheet is baked at a temperature of not lower than 350° C. As the result, the present invention has been accomplished.

Figure 2:
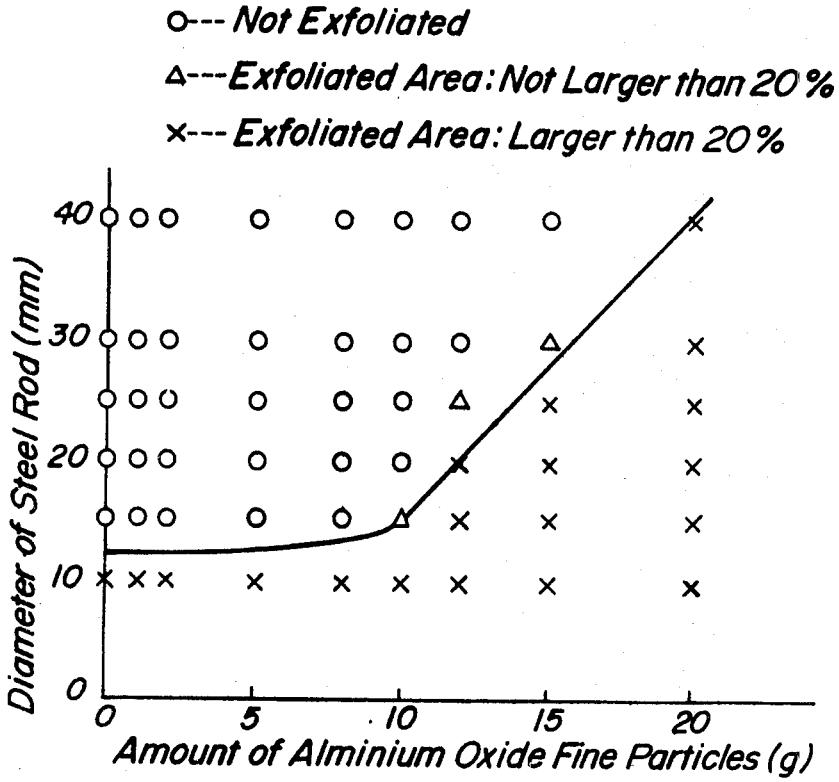
Figure 3:
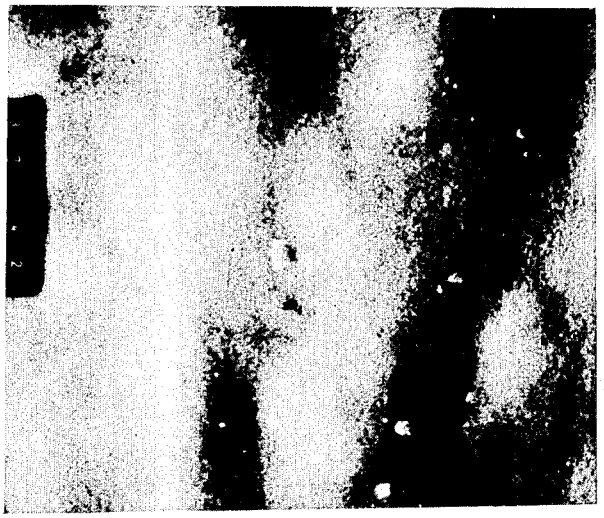
Figure 4:
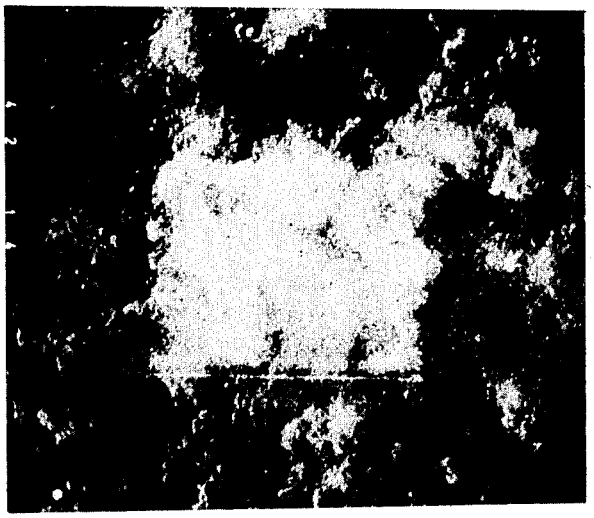
Figure 5:
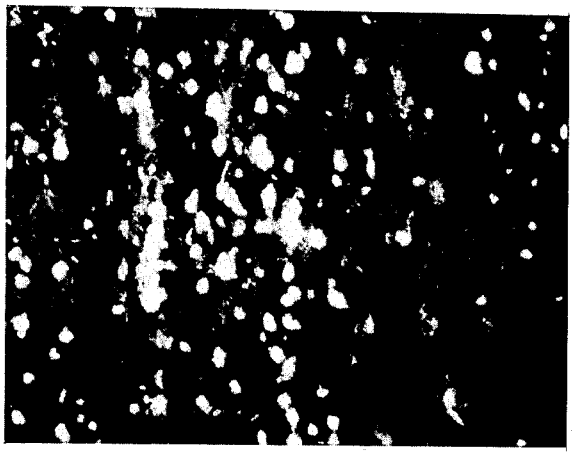

For a better understanding of the present invention, reference may be made to the accompanying drawings, in which:

FIG. 1 is a graph showing a relation between the amount of $SiO_2$ fine particles contained in the aqueous coating dispersion of the present invention and the result of peeling test of the resulting coating;

FIG. 2 is a graph showing a relation between the amount of $Al_2O_3$ fine particles contained in the aqueous coating dispersion of the present invention and the result of peeling test of the resulting coating; and FIGS. 3–5 are scanning election microscopic photographs of coatings, which are obtained by applying aqueous coating dispersions 4–6 in Examples 4–6 to silicon steel sheets and baking the coated steel sheets, respectively.

The present invention will be explained in more detail.

The coating is generally formed on a crystalline forsterite-ceramic film formed on a steel sheet by the reaction of a silica with magnesia used as an annealing separator in the box annealing.

The inventors have already clarified that conventional overlaid coating fuses and sticks easily, because the coating is composed of glass having a glass deformation temperature Td of about 600°–800° C.

The inventors have found that the sticking resistance of conventional coating can be improved by adding at least one of powdery $SiO_2$, $Al_2O_3$ and $TiO_2$ having specifically limited particle size and property to conventional glass-forming material. In general, when an aqueous coating dispersion containing a powdery oxide having a high melting point is applied to a steel sheet and the coated steel sheet is baked, the heat resistance of the resulting coating is improved, but the adhesion of the coating becomes poor, the space factor of the coated steel sheet is decreased, and the oxide particles exfoliate from the surface of the coated steel sheet at the slitting of the sheet or at the assembling of an iron core.

The inventors have made various investigations with respect to the oxides to be contained in the aqueous coating dispersion and succeeded in the formation of an excellent insulating coating by using $SiO_2$, $Al_2O_3$ and $TiO_2$ having a specifically limited particle size and a specifically limited apparent density.

In the present invention, at least one compound selected from chromic acid anhydride, chromate and dichromate is contained in the aqueous coating dispersion in an amount of 0.1–20 g, preferably 2–14 g, calculated as $CrO_3$, based on 22.4 g, calculated as $SiO_2$, of colloidal silica dispersed in the coating dispersion. The metal, which forms chromate and dicromate may be alkali metal, alkaline earth metal and any other metals. When chromic acid or dichromic acid is formed in the aqueous coating dispersion, the object of the present invention can be attained.

The reason why the amount of chromic acid anhydride, chromate and dichromate to be contained in the aqueous coating dispersion is limited to 0.1–20 g, calculated as $CrO_3$, based on 22.4 g, calculated as $SiO_2$, of colloidal silica dispersed therein is as follows. The use of chromic acid anhydride, chromate and dichromate in the above described amount serves to apply uniformly the aqueous coating dispersion to a steel sheet and to improve the hygroscopicity resistance of the resulting coating. However, when the amount is less than 0.1 g, neither the coating dispersion can be uniformly applied to a steel sheet, nor the hygroscopicity resistance of the resulting coating can be improved, while when the amount exceeds 20 g, the hygroscopicity resistance of the resulting coating can be improved, but the coating dispersion can not be applied uniformly. Therefore, the amount of chromic acid anhydride, chromate and dichromate contained in the aqueous coating dispersion must be limited to 0.1–20 g, calculated as $CrO_3$, based on 22.4 g, calculated as $SiO_2$, of colloidal silica.

The reason why at least one of monobasic phosphates of Mg, Al, Sr, Ba and Fe is used in the present invention is as follows. Colloidal silica is poor in the reactivity with the magnesium silicate film and further is poor in the mutual adhesion. Therefore, in order to improve these drawbacks, the monobasic phosphate is used as a binder. As the metal for forming monobasic phosphate, Mg, Al, Sr, Ba and Fe are used.

The monobasic phosphate of these metals improves the adhesion of a coating and further produces a coating having a hygroscopicity lower than the hygroscopicity of a coating containing monobasic phosphate of other metals. Therefore, the monobasic phosphate of the above described metals can be advantageously used in the present invention.

The reason why the molar ratio of $SiO_2$ in colloidal silica/monobasic phosphate is limited to 0.8/1–15/1 in the present invention is as follows. When the molar ratio is higher than 15/1, that is, when the amount of monobasic phosphate is too small, the adhesion of the resulting coating becomes poor. While, when the molar ratio is lower than 0.8/1, that is, when the amount of monobasic phosphate is too large, the resulting coating is hygroscopic and is poor in the heat resistance, and further the coating can not give a sufficiently high tension to a steel sheet. Therefore, the molar ratio of $SiO_2$ in colloidal silica/monobasic phosphate should be limited within the range of 0.8/1–15/1 in the present invention.

The preferable molar ration of $SiO_2$ in colloidal silica/monobasic phosphate varies depending upon the kind of metals, which form monobasic phosphate, and is as follows.

| | Preferable molar ratio of $SiO_2$ in colloidal silica/monobasic phosphate |
|---|---|
| Magnesium monobasic phosphate | 1.5/1–9/1 |
| Aluminum monobasic phosphate | 1.5/1–8/1 |
| Strontium monobasic phosphate | 3/1–12/1 |
| Barium monobasic Phosphate | 3/1–12/1 |
| Iron monobasic phosphate | 4/1–14/1 |

The coating formed on a steel sheet by the use of the above described range of molar ratio of $SiO_2$ in colloidal silica/monobasic phosphate gives a higher tension to the steel sheet, and can suppress more effectively the magnetostriction of the steel sheet under compression stress.

Then, the influence of the amount of $SiO_2$ and $Al_2O_3$ fine particles contained in the aqueous coating dispersion of the present invention upon the adhesion of the resulting coating will be explained with reference to FIGS. 1 and 2.

FIG. 1 is a graph showing a relation between the amount of $SiO_2$ fine particles contained in the aqueous coating dispersion, said amount being based on 22.4 g, calculated as $SiO_2$, of colloidal silica dispersed therein, and the results of peeling test of the coating formed on a silicon steel sheet in the following manner. Magnesium monobasic phosphate is mixed with 22.4 g, calculated as $SiO_2$, of colloidal silica dispersed in water in a molar ratio of $SiO_2$ in the colloidal silica/monobasic phosphate of 3.4/1. To the mixture are added 3 g of chromic acid anhydride, a variant amount of 0–20 g of $SiO_2$ fine particles (trademark AEROSIL-200, made by Nippon Aerosil Co.) having a primary particle size of 120 A and an apparent density of 60 g g/l and water to prepare an aqueous coating dispersion having a specific gravity of 1.20. The aqueous coating dispersion is applied to a forsterite-ceramic film formed on a silicon steel sheet in such an amount that a coating having a thickness of about $2\mu$ is formed after baking, and the coated steel sheet is baked at 800° C. to form a coating on the steel sheet.

FIG. 2 is a graph showing the same relation as that of FIG. 1, wherein $Al_2O_3$ fine particles having a primary particle size of 200 A and an apparent density of 60 g/l is used in place of $SiO_2$ fine particles (AEROSIL-200).

In the investigation of the present invention, the adhesion of the insulating coating obtained by applying the above described aqueous coating dispersion to a forsterite-ceramic film formed on a silicon steel sheet, and baking the coated steel sheet, is estimated in the following manner. A coated steel sheet is bent by 180° around steel rods having a diameter of 10, 15, 20, 25, 30 or 40 mm, and whether the coating on the bending side of the coated steel sheet exfoliates or not is observed. A coating having a high adhesion does not exfoliate even when a steel sheet having the coating is bent around a steel rod having a diameter of as small as 15 mm. While, a coating having a poor adhesion exfoliates even when a steel sheet having the coating is bent around a steel rod having a diameter of as large as 30 mm or 40 mm. The numerical value in the column under the subheading of "Peeling test by bending" in the following Table 1 means the minimum diameter of the above described steel rods, around which the coated steel sheet can be bent without exfoliation of the coating.

TABLE 1-(1)-1

| | Aqueous coating dispersion | | | | Oxide | | | |
|---|---|---|---|---|---|---|---|---|
| | Colloidal silica | Monobasic phosphate | Chromic acid (or salt) | Molar ratio of $SiO_2$/monobasic phosphate | Kind | Particle size A | Apparent density (g/l) | Amount (g) |
| Comparative experiment (1) | 20% aqueous dispersion, 100cc. | 35% aq. soln. of magnesium monobasic phosphate, 50cc. | $CrO_3$, 3g | 3.45 | Not added | — | — | — |
| Experiment (1) of the present invention | 20% aqueous dispersion 100cc. | 35% aq. soln. of magnesium monobasic phosphate, 50cc. | $CrO_3$, 3g | " | $SiO_2$ (AEROSIL-200) | 120 | 60 | 0.5 |
| Experiment (2) of the present invention | 20% aqueous dispersion 100cc. | 35% aq. soln. of magnesium monobasic phosphate, 50cc. | $CrO_3$, 3g | " | $SiO_2$ (AEROSIL-200) | " | " | 3 |
| Comparative experiment (2) | 20% aqueous dispersion 100cc. | 35% aq. soln. of magnesium monobasic phosphate, 50cc. | $CrO_3$, 3g | " | $SiO_2$ (AEROSIL-200) | " | " | 7 |
| Experiment (3) of the present invention | 20% aqueous dispersion 100cc. | 35% aq. soln. of magnesium monobasic phosphate, 50cc. | $CrO_3$, 3g | " | $Al_2O_3$ (Aluminum Oxide C) | 200 | " | 0.5 |
| Experiment (4) of the present invention | 20% aqueous dispersion 100cc. | 35% aq. soln. of magnesium monobasic phosphate, 50cc. | $CrO_3$, 3g | " | $Al_2O_3$ (Aluminum Oxide C) | " | " | 8 |
| Comparative experiment (3) | 20% aqueous dispersion 100cc. | 35% aq. soln. of magnesium monobasic phosphate, 50cc. | $CrO_3$, 3g | " | $Al_2O_3$ (Aluminum Oxide C) | " | | |
| Comparative experiment (4) | 20% aqueous dispersion, 100cc. | 35% aq. soln. of magnesium monobasic phosphate, 50cc. | $CrO_3$, 3g | " | $SiO_2$ (silicic acid anhydride commercial reagent) | 99.8% of the powders pass through 325-mesh seive | 1,300 | 0.5 |
| Comparative experiment (5) | 20% aqueous dispersion 100cc. | 35% aq. soln. of magnesium monobasic phosphate, 50cc. | $CrO_3$, 3g | " | $SiO_2$ (NIPSIL-VN3) | 160 | 250 | 0.5 |
| Experiment (5) of the present invention | 20% aqueous dispersion 100cc. | 35% aq. soln. of magnesium monobasic phosphate, 50cc. | $CrO_3$, 3g | " | $SiO_2$ (Aerosil-380) | 70 | 60 | 0.5 |
| Experiment (6) of the present invention | 20% aqueous dispersion 100cc. | 35% aq. soln. of magnesium monobasic phosphate, 50cc. | $CrO_3$, 3g | " | $TiO_2$ (Titanium Oxide P-25) | 300 | 80 | 0.5 |

| | Magnetic Properties | |
|---|---|---|
| | $B_{10}$ (T) | $W_{17/50}$ (W/Kg) |
| Comparative experiment (1) | 1.92 | 1.12 |
| Experiment (1) of the present invention | 1.92 | 1.12 |
| Experiment (2) of the present | 1.93 | 1.13 |
| Comparative Experiment (2) | 1.91 | 1.12 |
| Experiment (3) of the present invention | 1.92 | 1.11 |
| Experiment (4) of the present invention | 1.93 | 1.11 |
| Comparative | | |

TABLE 1-(1)-1-continued

| | | |
|---|---|---|
| Experiment (3) | 1.91 | 1.13 |
| Comparative experiment (4) | 1.92 | 1.12 |
| Comparative experiment (5) | 1.92 | 1.13 |
| Experiment (5) of the present invention | 1.91 | 1.12 |
| Experiment (6) of the present invention | 1.93 | 1.10 |

TABLE 1-(1)-2

| | Magnetostriction under Compression stress ($\times 10^{-6}$) | | | | Properties of coating | | | |
|---|---|---|---|---|---|---|---|---|
| | 0 Kg/mm$^2$ | 0.3 Kg/mm$^2$ | 0.5 Kg/mm$^2$ | 0.7 Kg/mm$^2$ | Insulation resistance ($\Omega$·cm$^2$/sheet) | Space factor (%) | Peeling test by bending (mm) | Sticking resistance at the stress relief annealing and appearance after the annealing |
| Comparative experiment (1) | 1.0 | 0.7 | 2.1 | 6.2 | 160 | 97.8 | 15 | Coated steel sheets stick partly to each other. When the stuck steel sheets are peeled off, the coating exfoliates from the steel sheet. |
| Experiment (1) of the present invention | 1.0 | 0.8 | 2.0 | 6.8 | at least 200 | 97.8 | 15 | Coated steel sheets do not at all stick to each other. Even after the stress relief annealing, the coated steel sheet has smooth surface and beautiful appearance. |
| Experiment (2) of the present invention | 0.9 | 0.7 | 2.0 | 6.5 | " | 97.7 | 15 | Coated steel sheets do not at all stick to each other. Even after the stress relief annealing, the coated steel sheet has smooth surface and beautiful appearance. |
| Comparative experiment (2) | 1.0 | 0.8 | 2.1 | 6.8 | " | 97.3 | 25 | Coated steel sheets do not at all stick to each other, but coated steel sheet surface is somewhat white. |
| Experiment (3) of the present invention | 1.0 | 0.7 | 2.3 | 6.5 | " | 97.8 | 15 | Coated steel sheets do not at all stick to each other. Even after the stress relief annealing, the coated steel sheet has smooth surface and beautiful appearance. |
| Experiment (4) of the present invention | 0.9 | 0.7 | 1.0 | 5.6 | " | 97.8 | 15 | Coated steel sheets do not at all stick to each other. Even after the stress relief annealing, the coated steel sheet has smooth surface and beautiful appearance. |
| Comparative experiment (3) | 0.8 | 0.7 | 1.8 | 6.2 | " | 97.0 | 30 | Coated steel sheets do not at all stick to each other, but coated steel sheet surface is somewhat white. |
| Comparative experiment (4) | 1.0 | 0.8 | 2.3 | 6.8 | " | 95.5 | 40 | Coating has a high heat resistance, but the coated steel sheet surface is rough. When the coated steel sheet surface is rubbed, the steel sheet surface is covered with powders. |
| Comparative experiment (5) | 0.9 | 0.7 | 2.3 | 6.5 | " | 96.0 | 25 | Coating has a high heat resistance, but the coated steel sheet surface is rough because of the agglomerated $SiO_2$ particles. |
| Experiment (5) of the present invention | 0.8 | 0.8 | 2.0 | 6.0 | " | 97.9 | 15 | Coated steel sheets do not at all stick to each other. Even after the stress relief annealing, the coated steel sheet has smooth surface and beautiful appearance. |
| Experiment (6) of the present invention | 0.9 | 0.7 | 2.5 | 6.5 | " | 97.7 | 15 | Coated steel sheets do not at all stick to each other. Even after the stress relief annealing, the coated steel sheet has smooth surface and beautiful appearance. |

TABLE 1-(2)-1

| | Aqueous coating dispersion | | | | Oxide | | | | Magnetic properties | |
|---|---|---|---|---|---|---|---|---|---|---|
| | Colloidal silica | Monobasic phosphate | Chromic acid (or salt) | Molar ratio of $SiO_2$/monobasic phosphate | Kind | Particle size (A) | Apparent density (g/l) | Amount (g) | $B_{10}$ (T) | $W_{17/50}$ (W/Kg) |
| Comparative experiment (6) | 20% aqueous dispersion, 100cc | 50% aq. soln. of aluminum monobasic phosphate, 60cc | $CrO_3$, 6g | 2.76 | Not added | — | — | — | 1.92 | 1.13 |
| Experiment (7) of the present invention | 20% aqueous dispersion, 100cc | 50% aq. soln. of aluminum monobasic phosphate, 60cc | $CrO_3$, 6g | " | $SiO_2$ (AEROSIL-200) | 120 | 60 | 0.5 | 1.93 | 1.12 |
| Comparative experiment (7) | 20% aqueous dispersion, 100cc | 20% aq. soln. of strontium monobasic phosphate, 70cc | $CrO_3$, 3g | 5.83 | Not added | — | — | — | 1.92 | 1.10 |
| Experiment (8) of the present invention | 20% aqueous dispersion, 100cc | 20% aq. soln. of strontium monobasic phosphate, 70cc | $CrO_3$, 3g | " | $Al_2O_3$ (Aluminum Oxide C) | 200 | 60 | 3 | 1.93 | 1.12 |
| Comparative experiment (8) | 20% aqueous dispersion, 100cc | 20% aq. soln. of barium monobasic phosphate, 80cc | $CrO_3$, 3g | " | Not added | — | — | — | 1.92 | 1.13 |
| Experiment (9) of the present invention | 20% aqueous dispersion, 100cc | 20% aq. soln. of barium monobasic phosphate, 80cc | $CrO_3$, 3g | " | $TiO_2$ (Titanium Oxide P-25) | 300 | 80 | 0.5 | 1.93 | 1.13 |
| Comparative experiment (9) | 20% aqueous dispersion, 100cc | 20% aq. soln. of iron monobasic, phosphate, 90cc | $CrO_3$, 3g | 4.19 | Not added | — | — | — | 1.93 | 1.14 |
| Experiment (10) of the present invention | 20% aqueous dispersion, 100cc | 20% aq. soln. of iron monobasic, phosphate, 90cc | $CrO_3$, 3g | " | $Al_2O_3$ (Aluminum Oxide C) | 200 | 60 | 3 | 1.92 | 1.14 |
| Comparative experiment (10) | 20% aqueous dispersion, 100cc | 35% aq. soln. of magnesium monobasic phosphate, 30cc and 50% aq. soln. of aluminum monobasic phosphate, 30cc | $CrO_3$, 3g | 2.83 | Not added | — | — | — | 1.91 | 1.14 |
| Experiment (11) of the present invention | 20% aqueous dispersion, 100cc | 35% aq. soln. of magnesium monobasic phosphate, 30cc and 50% aq. soln. of aluminum monobasic phosphate, 30cc | $CrO_3$, 3g | " | $SiO_2$ | 120 | 60 | 0.5 | 1.91 | 1.13 |

TABLE 1-(2)-2

| | Magnetostriction under Compression stress ($\times 10^{-6}$) | | | | Properties of coating | | | |
|---|---|---|---|---|---|---|---|---|
| | 0 Kg/mm² | 0.3 Kg/mm² | 0.5 Kg/mm² | 0.7 Kg/mm² | Insulation resistance ($\Omega$·cm²/sheet) | Space factor (%) | Peeling test by bending (mm) | Sticking resistance at the stress relief annealing and appearance after the annealing |
| Comparative experiment (6) | 1.0 | 0.7 | 3.4 | 8.3 | 150 | 97.7 | 25 | Coated steel sheets stick partly to each other. When the stuck steel sheets are peeled off, the coating exfoliates from the steel sheet. |
| Experiment (7) of the present invention | 1.1 | 0.8 | 3.5 | 8.0 | at least 200 | 97.8 | 25 | Coated steel sheets do not at all stick to each other. Even after the stress relief annealing, the coated steel sheet has smooth surface and beautiful appearance |
| Comparative experiment (7) | 1.5 | 0.8 | 2.5 | 7.5 | 150 | 98.0 | 20 | Coated steel sheets stick partly to each other. When the stuck steel sheets are peeled off, the coating exfoliates from the steel sheet. |
| Experiment (8) of the present invention | 1.3 | 0.8 | 3.0 | 8.0 | at least 200 | 97.8 | 20 | Coated steel sheets do not at all stick to each other. Even after the stress relief annealing, the coated steel sheet has smooth surface and beautiful appearance |
| Comparative experiment (8) | 1.0 | 0.7 | 3.5 | 7.5 | 170 | 97.7 | 20 | Coated steel sheets stick partly to each other. When the stuck steel sheets are peeled off, the coating |

TABLE 1-(2)-2-continued

| | Magnetostriction under Compression stress ($\times 10^{-6}$) | | | | Properties of coating | | | |
|---|---|---|---|---|---|---|---|---|
| | 0 Kg/mm² | 0.3 Kg/mm² | 0.5 Kg/mm² | 0.7 Kg/mm² | Insulation resistance (Ω·cm²/sheet) | Space factor (%) | Peeling test by bending (mm) | Sticking resistance at the stress relief annealing and appearance after the annealing |
| | | | | | | | | exfoliates from the steel sheet. |
| Experiment (9) of the present invention | 1.0 | 0.8 | 3.0 | 7.8 | at least 200 | 97.7 | 20 | Coated steel sheets do not at all stick to each other. Even after the stress relief annealing, the coated steel sheet has smooth surface and beautiful appearance |
| Comparative experiment (9) | 0.9 | 0.8 | 2.5 | 7.8 | 160 | 97.8 | 20 | Coated steel sheets stick partly to each other. When the stuck steel sheets are peeled off, the coating exfoliates from the steel sheet. |
| Experiment (10) of the present invention | 1.0 | 0.9 | 3.5 | 8.5 | at least 200 | 97.8 | 20 | Coated steel sheets do not at all stick to each other. Even after the stress relief annealing, the coated steel sheet has smooth surface and beautiful appearance |
| Comparative experiment (10) | 1.0 | 0.7 | 2.5 | 7.0 | 170 | 97.9 | 20 | Coated steel sheets stick partly to each other. When the stuck steel sheets are peeled off, the coating exfoliates from the steel sheet. |
| Experiment (11) of the present invention | 1.0 | 0.8 | 2.8 | 7.5 | at least 200 | 97.8 | 20 | Coated steel sheets do not at all stick to each other. Even after the stress relief annealing, the coated steel sheet has smooth surface and beautiful appearance |

In FIGS. 1 and 2, the mark "o" shows coated steel sheet samples, in which the coating did not exfoliate at all, the mark "Δ" shows the samples, in which the exfoliated area of the coating was not larger than 20%, and the mark "X" shows the samples, in which the exfoliated area of the coating was larger than 20%.

It can be seen from FIGS. 1 and 2 that, when the amount of $SiO_2$ fine particles or $Al_2O_3$ fine particles contained in the aqueous coating dispersion exceeds a certain amount, the adhesion of the resulting coating becomes poor, and that the upper limits of the amounts of the $SiO_2$ and $Al_2O_3$ fine particles are 5 g and 10 g respectively based on 22.4 g of $SiO_2$ in colloidal silica. Further, it has been found from the same experiment as the experiments shown in FIGS. 1 and 2 by the use of $TiO_2$ fine particles that the upper limit of the amount of $TiO_2$ fine particles is 5 g based on 20 g of $SiO_2$ in colloidal silica. In the present invention, $SiO_2$, $Al_2O_3$ and $TiO_2$ fine particles can be used alone or in admixture, and when a mixture of fine particles of at least two of these oxides is used, the upper limit of the amount of the mixture can be determined by repeating the same experiment as those shown in FIGS. 1 and 2.

While, the lower limit of the amount of the above described oxides can be determined by the following sticking test. Steel sheets having a coating to be tested are laminated, and the laminated steel sheets are kept at 800° C. for 3 hours under a load of 2 Kg/cm² in nitrogen atomsphere and cooled, and then the stuck state of the steel sheet surface is observed. The results of this test carried out in the investigation of the present invention are also shown in Table 1. In Table 1, "$SiO_2$ (silicic acid anhydride commercial reagent)" is commercially available fine particle silicic acid anhydride having such a particle size that 99.8% of the particles pass through the 325-mesh sieve; and the "$SiO_2$ (NIPSIL-VN3)" is fine particle silica made through the wet process by Nippon Silica Kogyo Co., and is one of fine particle silicas generally called as white carbon.

It can be seen from Table 1 that sticking occurs in any of Comparative experiments (1), (6), (7), (8), (9) and (10) using an aqueous coating dispersion containing no oxide, and that the sticking of the resulting coating can be prevented by the use of an aqueous coating dispersion containing a proper amount of the oxide. As the results of the above descripbed experiments, it has been found that the particularly preferable amounts of the oxides to be contained in the aqueous coating dispersion based on 22.4 g of $SiO_2$ in colloidal silica are as follows. That is, the amount of $SiO_2$ is 0.1–3 g, that of $Al_2O_3$ is 0.2–8 g and that of $TiO_2$ is 0.1–3 g.

The inventors have further made experiments with respect to the particle size and apparent density of the oxides to be contained in the aqueous coating dispersion and found that, even when coarse particle oxides are used, the sticking resistance of the resulting coating is improved, but the space factor of the coated steel sheet is decreased and white powders are observed on the coated steel sheet surface. This fact is clear from the result of Comparative experiments (4) and (5). In order to obviate this drawback, the inventors have made further various investigations with respect to the particle size and apparent density of the oxide, and found that the primary particle size of the oxide must be 70-500 Å and the apparent density thereof must be not higher than 100 g/l in order to form a coating having an excellent appearance without decreasing the space factor of coated steel sheet.

The above described primary particle size of the oxide was measured in the following manner. Oxide particles to be measured were homogeneously mixed, and the size of the smalles unit particle in the sample particles was measured by an electron microscope. The apparent density of the oxide was measured by pouring quietly the sample powder into a measuring cylinder inclined at 45° and calculating the weight of the sample powder required for occupying a certain limited volume.

As described above, in order to form a coating having a high adhesion property without decreasing the space factor of the coated steel sheet by dispersing a heat-resistant oxide in an aqueous coating dispersion of vitreous material, it is necessary that the particle size of the heat-resistant oxide must be very small. However, the inventors have found that merely the limitation of primary particle size of the oxide to a small size is not sufficient for this purpose. Because, when an aqueous coating dispersion containing an oxide having such a particle size that, although the primary particle size is small, a large amount of the primary particles are agglomerated, is applied to a steel sheet, the resulting coating is poor in the adhesion due to the agglomerated primary particles of the oxide, and a large amount of projections are formed on the surface of the coated steel sheet to decrease the space factor of the steel sheet, and the agglomerates exfoliate from the steel sheet surface at the assembling of iron core. Therefore, an oxide having a low agglomeration degree of primary particle must be used in order to prevent such drawbacks.

The agglomeration degree of powders is influenced by the electric property of atmosphere, the pressure applied to the powders and the impurity contained therein. Particularly, the agglomeration degree of powders is highly influenced by the production method. In general, methods for producing fine particle silica are classified into two processes of dry process and wet process, and fine particles silica obtained by the low concentration gas phase synthesis (by the high temperature hydrolysis of gaseous silicon chloride) is entirely different from fine particle silica obtained by the wet process in the agglomeration degree. The inventors have found out that the apparent density is suitable as a measure for estimating the agglomeration degree of primary particle. Accordingly, it is necessary that the oxide to be used for improving the heat resistance of the resulting coating should be limited by both of the primary particle size and apparent density.

The inventors have found from the results of experiments by the use of various fine particle silicas (white carbons) obtained by the wet process and various fine particle $SiO_2$, $Al_2O_3$ and $TiO_2$ obtained by the high-temperature hydrolysis of clorides in gaseous state that, when an aqueous coating dispersion containing a small amount of a hardly agglomerative fine particle oxide having an apparent density of not higher than 100 g/l is used, the heat resistance of the resulting coating can be improved without deteriorating the adhesion, smoothness and strength thereof.

In the present invention, it is necessary that the aqueous coating dispersion should be applied to a steel sheet after the specific gravity thereof is adjusted to 1.05–1.30.

It is preferable to apply the aqueous coating dispersion to a silicon steel sheet in an amount that the thickness of the coating after baking is about 1–3$\mu$. When the coating is too thin, the coating can not give a tension to the steel sheet, and the magnetostriction of the steel sheet can not be suppressed. While, when the coating is too thick, the magnetostriction of the steel sheet can be suppressed, but the adhesion of the coating at bending is poor, and the space factor of the coated steel sheet is decreased.

Further, it is preferable to keep the aqueous coating dispersion at a temperature of not higher than 35° C. in order to prevent the deterioration of the properties.

In the present invention, a steel sheet applied with the aqueous coating dispersion is baked at a temperature of 350°–850° C. to form an insulating coating. When the baking temperature is lower than 350° C., the insulating coating aimed in the present invention can not be formed. While, when the baking temperature is higher than 850° C., the adhesion property of the coating is poor. Therefore, the baking temperature should be limited within the range of 350°–850° C.

When the baking is effected in two steps, in which a steel sheet applied with the aqueous coating dispersion is firstly heated at a temperature of lower than 500° C. to remove substantially water contained in the coated steel sheet and then heated at a temperature of 700°–850° C. to bake the coated steel sheet, a coating having a beautiful appearance and capable of suppressing the magnetostriction of the steel sheet under compression stress can be formed. Following to the heating of a coated steel sheet at a temperature of lower than 500° C., at least 30 seconds of heating of the sheet at 800° C. is sufficient for forming the coating aimed in the present invention. The atmosphere for heating a coated steel sheet at a temperature of lower than 500° C. may be oxidizing, neutral or weak reducing atmosphere. However, the atmosphere for heating a coated steel sheet at a temperature of 700°–850° C. is preferred to be neutral or weak oxidizing atmosphere. When the heating of the steel sheet at a temperature of 700°–850° C. is effected under a reducing atmosphere, such as $N_2$ 90%+$H_2$ 10%, reduction of $P^{5+}$ is caused, and a good result cannot be obtained.

The following examples are given for the purpose of illustration of this invention and are not intended as limitations thereof.

EXAMPLES 1–3

An oriented silicon steel sheet rolled to a final gauge of 0.30 mm and containing 1–4% of Si was subjected to a decarburization annealing, and a oxide layer containing $SiO_2$ was simultaneously formed on the surface of the steel sheet. Then, a separator consisting mainly of an MgO-water slurry was applied to the sheet surface, and after the separator was dried, the steel sheet was wound into a coil shape and annealed at 1,200° C. for 20 hours under hydrogen atmosphere to form a forsterite-ceramic film on the surface of the oriented silicon steel sheet.

The oriented silicon steel sheet having the forsterite-ceramic film thereon was washed with water to remove unreacted separator, and the following aqueous coating dispersions, each having a specific gravity of 1.20 and the following composition, were applied to the steel sheet by means of a grooved roll, and the coated steel sheets were baked at 800° C.

The following Table 2 shows the characteristic properties of the resulting coated silicon steel sheets. The steel sheets are remarkably superior to conventional coated oriented silicon steel sheets in any of the magnetic properties, the magnetostriction under compression stress and the properties of coating. Particularly, the sheets do not at all stick to each other during the stress relief annealing, and have smooth surface and beautiful appearance after the stress relief annealing.

Aqueous coating dispersion No. 1 (Example 1)

Colloidal silica (20% aqueous dispersion)—100 l
Magnesium monobasic phosphate (35% aqueous solution)—50 l
Chromic acid anhydride—3 Kg
Fine particle $Al_2O_3$ (Aluminium Oxide C, made by Degussa Co., West Germany)—3 Kg
Molar ratio of $SiO_2$ in colloidal silica/monobasic phosphate=3.45

Aqueous coating dispersion No. 2 (Example 2)

Colloidal silica (20% aqueous dispersion)—100 l
Magnesium monobasic phosphate (35% aqueous solution)—60 l
Chromic acid anhydride—3 Kg
Fine particle $SiO_2$ (AEROSIL-100, made by Nippon Aerosil Co.)—0.5 Kg
Molar ratio of $SiO_2$ in colloidal silica/monobasic phosphate=2.87

Aqueous coating dispersion No. 3 (Example 3)

Colloidal silica (20% aqueous dispersion)—100 l
Magnesium monobasic phosphate (35% aqueous solution)—45 l
Chromic acid anhydride—3 Kg
Fine particle $TiO_2$ (Titanium Oxide P-25, made by Degussa Co., West Germany)—0.5 Kg
Molar ratio of $SiO_2$ in colloidal silica/monobasic phosphate=3.83

1-3, and the coated steel sheets were baked in the same manner as described in Example 1-3.

Aqueous coating dispersion No. 4 (Example 4) consists of 100 cc of an aqueous dispersion containing 22.4 g, calculated as $SiO_2$, of colloidal silica, 50 cc of a 35% aqueous solution of magnesium monobasic phosphate and 3 g of chromic acid anhydride.

Aqueous coating dispersion No. 5 (Example 5) is a mixture of aqueous coating dispersion No. 4 and 0.5 g of fine particle silica (AEROSIL-200), which is obtained by a high-temperature hydrolysis of silicon tetrachloride and has an apparent density of not higher than 100 g/l.

Aqueous coating dispersion No. 6 (Example 6) is a mixture of aqueous coating dispersion No. 4 and 0.5 g of fine particle silica (NIPSIL-VN3).

FIGS. 3-5 are scanning electron microscopical photographs of the surface of the coatings formed on the steel sheet. That is, FIG. 3 is the photograph of the surface of the coating formed by the use of coating

TABLE 2

| Example | Aqueous coating dispersion No. | Magnetic properties $B_{10}$ (T) | Magnetic properties $W_{17/50}$ (W/Kg) | Magnetostriction under compression stress ($\times 10^{-6}$) 0 Kg/mm² | 0.3 Kg/mm² | 0.5 Kg/mm² | 0.7 Kg/mm² | Properties of coating: Insulation resistance (Ω·cm²/sheet) | Space Factor (%) | Peeling test by bending (mm) | Sticking resistance at the stress relief annealing |
|---|---|---|---|---|---|---|---|---|---|---|---|
| 1 | 1 | 1.93 | 1.11 | 0.8 | 0.7 | 1.0 | 5.3 | at least 200 | 97.9 | 15 | Coated steel sheets do not at all stick to each other. Even after the stress relief annealing, the coated steel sheet has smooth surface and beautiful appearance |
| 2 | 2 | 1.92 | 1.12 | 0.9 | 0.7 | 1.5 | 6.0 | at least 200 | 98.0 | 15 | Coated steel sheets do not at all stick to each other. Even after the stress relief annealing, the coated steel sheet has smooth surface and beautiful appearance. |
| 3 | 3 | 1.93 | 1.09 | 1.0 | 0.7 | 1.5 | 6.2 | at least 200 | 97.8 | 15 | Coated steel sheets do not at all stick to each other. Even after the stress relief annealing, the coated steel sheet has smooth surface and beautiful appearance. |

EXAMPLES 4-6

The following three aqueous coating dispersions Nos. 4-6 were applied to the oriented silicon steel sheet having the forsterite-ceramic film and obtained in Examples dispersion No. 4, FIG. 4 is that formed by the use of coating dispersion No. 5 and FIG. 5 is that formed by the use of coating dispersion No. 6.

The characteristic properties of the electric steel sheets obtained by applying these aqueous coating dispersions to an oriented silicon steel sheet and baking the coated steel sheet are shown in the following Table 3.

TABLE 3

| Example | Aqueous coating dispersion No. | Magnetic properties $B_{10}$ (T) | Magnetic properties $W_{17/50}$ (W/Kg) | Magnetostriction under compression stress ($\times 10^{-6}$) 0 Kg/mm² | 0.3 Kg/mm² | 0.5 Kg/mm² | 0.7 Kg/mm² | Properties of coating: Insulation resistance (Ω·cm²/sheet) | Space Factor (%) | Peeling test by bending (mm) | Sticking resistance at the stress relief annealing |
|---|---|---|---|---|---|---|---|---|---|---|---|
| 4 | 4 | 1.92 | 1.12 | 1.0 | 0.7 | 2.1 | 6.2 | 160 | 97.8 | 15 | Coated steel sheets stick partly to each other. When the coated steel sheets are |

TABLE 3-continued

| Example | Aqueous coating dispersion No. | Magnetic properties $B_{10}$ (T) | Magnetic properties $W_{17/50}$ (W/Kg) | Magnetostriction under compression stress ($\times 10^{-6}$) 0 Kg/mm² | 0.3 Kg/mm² | 0.5 Kg/mm² | 0.7 Kg/mm² | Properties of coating: Insulation resistance (Ω·cm²/sheet) | Space Factor (%) | Peeling test by bending (mm) | Sticking resistance at the stress relief annealing |
|---|---|---|---|---|---|---|---|---|---|---|---|
| | | | | | | | | | | | peeled off, the coating exfoliates from the steel sheet. |
| 5 | 5 | 1.92 | 1.12 | 1.0 | 0.8 | 2.0 | 6.8 | at least 200 | 97.8 | 15 | Coated steel sheets do not at all stick to each other. Even after the stress relief annealing, the coated steel sheet has smooth surface and beautiful appearance. |
| 6 | 6 | 1.92 | 1.13 | 0.9 | 0.7 | 2.3 | 6.5 | at least 200 | 96.0 | 15 | Coating has a high heat resistance, but the coated steel sheet surface is rough because of the agglomerated $SiO_2$ particles. |

It can be seen from FIGS. 3–5 that, when aqueous coating dispersion No. 6 containing fine particle silica (NIPSIL-VN3), which has a high apparent density and whose primary particles are relatively highly agglomerated, is used, a large number of projections consisting of the agglomerates having a particle size of about 1μ are formed on the surface of the coating. While, when aqueous coating dispersion No. 5 containing fine particle silica (AEROSIL-200), whose primary particles are relatively less agglomerated, is used, the oxide fine particles are dispersed quite uniformly in the coating. Further, it has been found that, when a mixture of aqueous coating dispersion No. 4 and aluminum oxide (Aluminum Oxide C) or titanium oxide (Titanium Oxide P-25), each of which is obtained by a high-temperature hydrolysis of chloride, consists of hardly agglomerative fine particles and has an apparent density of not higher than 100 g/l, is used, the oxide is dispersed quite uniformly in the coating to form a smooth surface similarly to the coating formed by the use of aqueous coating dispersion No. 5, and the coating has an improved sticking resistance without deteriorating the space factor of the coated steel sheet.

As described above, according to the present invention, an insulating coating having excellent heat resistance can be formed on an oriented silicon steel sheet surface, said coating being able to decrease the iron loss and suppress the magnetostriction of the steel sheet.

We claim:

1. In a method for forming a heat-resistant insulating coating on an oriented silicon steel sheet having a forsterite-ceramic film thereon, in which an aqueous coating dispersion having a specific gravity of 1.05–1.30, which is obtained by mixing (a) 22.4 parts by weight, calculated as $SiO_2$, of colloidal silica dispersed in water with (b) at least one of monobasic phosphates of Mg, Al, Sr, Ba and Fe in a molar ratio of $SiO_2$ in the colloidal silica/monobasic phosphate of 0.8/1–15/1, (c) 0.1–20 parts by weight of the total amount of at least one compound selected from chromic acid anhydride, chromates and dichromates, (d) 0.1–10 parts by weight of the total amount of at least one fine particle oxide selected from $SiO_2$, $Al_2O_3$, and $TiO_2$ and (e) water so as to adjust the specific gravity of the aqueous coating dispersion to the above described range, is applied to an oriented silicon steel sheet, and the coated steel sheet is baked at a temperature of not lower than 350°, the improvement comprising said fine particle oxide having a primary particle size of 70–500 Å and an apparent density of not higher than 100 g/l.

2. A method according to claim 1, wherein the aqueous coating dispersion is applied to the silicon steel sheet in an amount that the thickness of the coating after baking is about 1–3μ.

3. A method according to claim 1, wherein the amount of $SiO_2$ fine particle is 0.1–3 g.

4. A method according to claim 1, wherein the amount of $Al_2O_3$ fine particle is 0.2–8 g.

5. A method according to claim 1, wherein the amount of $TiO_2$ fine particle is 0.1–3 g.

6. A method according to claim 1, wherein the baking temperature is 350°–850° C.

7. A method according to claim 1, wherein the baking is effected in two steps, in which the coated steel sheet is firstly heated at a temperature of lower than 500° C. and then heated at a temperature of 700°–850° C.

8. A method according to claim 1, wherein said fine particle oxide is produced by the high temperature hydrolysis of chlorides in gaseous state.

* * * * *